US007810856B2

(12) United States Patent
Müller et al.

(10) Patent No.: US 7,810,856 B2
(45) Date of Patent: Oct. 12, 2010

(54) LOCKING SYSTEM

(75) Inventors: Ulrich Müller, Velbert (DE); Helmut Klein, Velbert (DE)

(73) Assignee: Huf Hulsbeck & Furst GmbH & Co. KG (DE)

( * ) Notice: Subject to any disclaimer, the term of this patent is extended or adjusted under 35 U.S.C. 154(b) by 0 days.

(21) Appl. No.: 11/476,968

(22) Filed: Jun. 29, 2006

(65) Prior Publication Data

US 2007/0001467 A1 Jan. 4, 2007

(30) Foreign Application Priority Data

Jun. 29, 2005 (EP) ..... 05014003

(51) Int. Cl.
*E05B 3/00* (2006.01)

(52) U.S. Cl. ..... 292/336.3; 292/DIG. 30

(58) Field of Classification Search ..... 292/336.3, 292/216, 201, DIG. 23, DIG. 30; 16/110.1; 340/5.72

See application file for complete search history.

(56) References Cited

U.S. PATENT DOCUMENTS

| | | | | |
|---|---|---|---|---|
| 4,093,289 | A * | 6/1978 | Inabayashi et al. | 292/336.3 |
| 6,148,651 | A * | 11/2000 | Roncin | 70/264 |
| 6,256,932 | B1 * | 7/2001 | Jyawook et al. | 49/503 |
| 6,439,623 | B1 * | 8/2002 | Lohfeld et al. | 292/201 |
| 6,530,251 | B1 * | 3/2003 | Dimig | 70/237 |
| 6,698,262 | B2 * | 3/2004 | Wittwer | 70/208 |
| 2001/0004233 | A1 | 6/2001 | Suparschi et al. | |

FOREIGN PATENT DOCUMENTS

| | | |
|---|---|---|
| DE | 19904663 A1 | 8/1997 |
| DE | 19617038 A1 | 11/1997 |
| DE | 19633894 A1 | 2/1998 |
| DE | 10331440 | 2/2005 |

* cited by examiner

*Primary Examiner*—Peter M Cuomo
*Assistant Examiner*—Kristina R Fulton
(74) *Attorney, Agent, or Firm*—Lowe Hauptman Ham & Berner, LLP

(57) ABSTRACT

The invention relates to a closing system for a door or a flap of a motor vehicle and comprises a lock, a door handle affixable to the door and fitted with an external grip element with a centralized locking motor linked to a control unit and operationally connected to the lock, whereby the closing system can be moved into a secured and into a disengaged state, and also comprises an opening motor acting as an opening accessory and/or a closing motor acting as a closing accessory for the lock.

The invention provides that the door handle be associated with a handle support which is configured internally on the side away from the grip element and which affixes the door handle to the door, said opening motor and/or the closing motor as well as the centralized locking motor being mounted on the handle support, where said opening motor and/or the closing motor as well as the centralized locking motor are connected directly, or indirectly by means of at least one force transmitting element, to the lock 3.

19 Claims, 2 Drawing Sheets

LOCKING SYSTEM

RELATED APPLICATIONS

The present application is based on, and claims priority from, European Application Number 05 014 003.7 filed on Jun. 29, 2005, the disclosure of which is hereby incorporated by reference herein in its entirety.

TECHNICAL FIELD

The present invention relates to a closing system for a motor vehicle door or flap employing a mechanical lock, a door handle affixable to the door and fitted with an external grip element, a central locking motor to which a control unit is both connected and operationally linked, whereby the closure system can be moved into a secured and a disengaged state, and an opening motor acting as an opening accessory and/or a closing motor acting as a closing accessory for said lock.

BACKGROUND

Many closing systems with closing accessories are known to the expert. The German patent document DE 199 04 663 A1 discloses a motor vehicle door lock which comprises an electrical closing accessory drive and an electrical opening accessory drive. In this design the lock comprises a catch and a pawl keeping the catch in the main notch position and the pre-notch position. The accessory closing drive is actuated after the lock catch has reached a pre-closing position and moves this catch by motor action into the main closing position.

According to said state of the art, the opening accessory drive is actuated when the pawl must be moved out of the latch's main notch position or pre-notch position. The said accessory drives consist of a drive motor and of a gear unit, both being configured in the immediate vicinity of the lock. One of the substantial drawbacks incurred in this design is that the space available for it in the vicinity of the mechanical lock is strongly restricted on account of the presence of a plurality of operational elements such as accessory motors etc. The purpose of the present invention is palliation.

Accordingly the objective of the present invention is to create a motor vehicle door or flap closing system circumventing the above drawbacks and providing in particular a closing system of simple design and offering economy of installation and compactness. Moreover the user shall be provided with a comfortable and reliable closing system to open and close the motor vehicle door and to secure and disengage the closing system.

The present invention provides that the door handle comprises a handle support configured inside the side away from the grip element and to affix the grip element to the door. The handle support is not visible to the user, being mounted in the car's door body, and being made in one illustrative embodiment of the invention of metal or plastic. The plastic illustrative may be a composite material. In another alternative of the present invention the said handle support may be a fiber-reinforced composite material, for instance of fibers made of glass and/or of carbon and/or aramide fibers imbedded in plastic. The particular advantage attained thereby is that the fiber-reinforced handle support offers high strength at low weight. One significant advantage of the present invention that the opening motor and/or the closing motor as well as the centralized locking motor are mounted on said handle support. The opening motor and/or the closing motor as well as the centralized locking motor are connected directly, or indirectly by means of at least one force transmitting element, to the lock. By moving the centralized locking motor as well as the accessory motors into the region of the door handle, additional space is made available for further elements. Because of the reduced number of components, the mechanical lock is substantially more compact and simpler, whereby the economy of installing the lock of the invention in the motor vehicle door is substantially increased. The accessory motors as well as the centralized locking motor may be connected for instance by a common force transmitting element to the lock. Another embodiment mode of the invention allows fitting each motor with its own force transmitting element to the lock. Such a force transmitting element preferably shall be a Bowden cable which is easily emplaced and affixed regardless of space restrictions. Obviously alternative force transmitting elements such as linkages also are applicable.

In one advantageous embodiment mode of the present invention, the closing element, the opening motor and the closing motor may be integrated into one motor unit. As a result the lock's opening and closing accessories are solely provided from one common motor unit. In order to keep low the costs of installing the closing system, the centralized locking motor and/or the opening motor and/or the closing motor appropriately are received in a single housing. The said motors are combined in this embodiment of the invention in one modular unit, allowing substantially simplifying the integration of the closing system into the motor vehicle door.

The accessory motors as well as the centralized locking motor are affixed in geometrically (positively) or frictionally locking or in fused manner to the handle support. Illustratively screw, weld connections, in particular laser welding, clamping or snug-fit connections are applicable. Advantageously furthermore the housing receiving the motors also may be affixed by means of the just cited connections.

The control unit is advantageously connected electrically to the closing motor and/or opening motor. Obviously a wireless connection for instance by radio or infrared is also conceivable in this respect. The control unit may be a centralized motor control unit which communicates with both the centralized locking motor and the accessory motors. It may be appropriate moreover to make use of an additional control for the closing system besides the centralized motor control unit.

In an alternative embodiment mode, the control unit also may be affixed to the door handle support. In this case the control unit also may be received in the said housing.

Appropriately the door handle comprises a keyless closing-system activation sensor in the form of a contact and/or proximity detector communicating with the control unit. Besides being connected electrically in physical manner, obviously the sensor and control unit also may be connected in wireless manner. Illustratively the user may use his/her hand in proximity to or by touching (with or without pressure) the grip element to activate the said sensor, to move the closing system into or out of the secured position. By means of such activation, the sensor can entail immediate securing or disengaging the closing system. Obviously also first a security check may have to be satisfied to find out whether said user is authorized for such vehicle securing or disengaging actions. Illustratively such checking devices are described in the German patent documents DE 103 31 440 A1 or DE 196 17 038 C2. The sensor may be capacitive, in which case the activation distance is smaller than 30 cm, preferably less than 1 cm. This deliberate selection of a small activation distance makes sure that the capacitive sensor can be activated only by deliberately moving the user's hand into the close vicinity of the sensor.

The sensor configured within the grip element may be piezoelectric, and consequently its activation takes place by touching the grip element in the zone of the piezoelectric sensor. In this embodiment mode the piezoelectric sensor is configured directly at the side of the handle away from the door. Already minute tension, pressure or thrust suffice to secure or disengage the closing system. Obviously other kinds of sensor may be used too for this application, for instance a Hall effect generator.

The closing system relates to a door handle which illustratively may be a folding handle, a pullout handle or a revolver grip. The particular grip element which requires manual displacement to effect door opening may be designed in one embodiment mode as being pivotable about a pivot axis, the door handle being fitted with an inner connection element configured at its free end to said pivot axis. Manually displacing and/or rotating the grip element opens the mechanical lock of the closing system by means of a force transmitting element provided that said centralized locking motor did previously move the closing system into the disengaged position.

In another alternative embodiment mode of the invention, the centrally locking motor is connected to a coupling which said motor can be moved into a coupled and a decoupled state and which can be operationally connected to the lock by an adjustment device. The closing system is secured in the coupling's decoupled state and is disengaged when said coupling is coupled. The displaceable grip element is connected through a force transmitting element to said coupling. The displacement impulse triggered by the motion of the grip element when taking place in the coupled state is transmitted through the force transmitting element to said coupling, In the coupled state this coupling transmits said displacement pulse to the adjustment device that correspondingly acts on the lock. There is no transmission of the displacement impulse in the decoupled state. The lock will be secure.

Besides offering the option of manually opening the motor vehicle door, the closing system of the invention alternatively also relates to door handles that do not respond to a displacement or pivoting of the grip element to open the door, whether by ignoring such phenomena or not being designed for them in the first place. In that case the grip elements are mounted rigidly and firmly to the door, the door handle being fitted with actuation surfaces that need only be touched by the user or that require the user to approach within a given distance to start the opening procedure.

Advantageously the door handle comprises an emergency cylinder. In a preferred embodiment mode, this cylinder is affixed to the handle support. In case of electronics malfunction (for instance inoperative ID detector), the vehicle may be opened by means of this emergency cylinder. The emergency key is inserted into a core of the emergency cylinder and by operating the key is moved from a first position into a disengaged or secure rotational position. Illustratively the cylinder core in its rest position may be kept in its first position by a pulse drive spring. The rotational impulse may be transmitted by the coupling's force transmission elements to allow securing and/or disengaging the lock.

In a further alternative embodiment mode of the invention, the centralized locking motor is configured in the zone of the emergency cylinder to which it is linked. Key rotation can be directly communicated to the centralized locking motor which then undertakes a corresponding actuation of the mechanical lock or at the coupling. Configuring the centralized locking motor in the immediate vicinity of the emergency cylinder was found to be eminently advantageous. Preferably the closing motor and the opening motor are affixed at the door handle side opposite the centralized locking motor.

Further advantages, features and particulars of the present invention are discussed in the description below which describes in detail several illustrative embodiment modes of the invention in relation to the appended drawings. The features cited in the claims and the description may be construed being inventive per se or in arbitrary combinations.

DETAILED DESCRIPTION OF EMBODIMENT

Figures 1, 2:
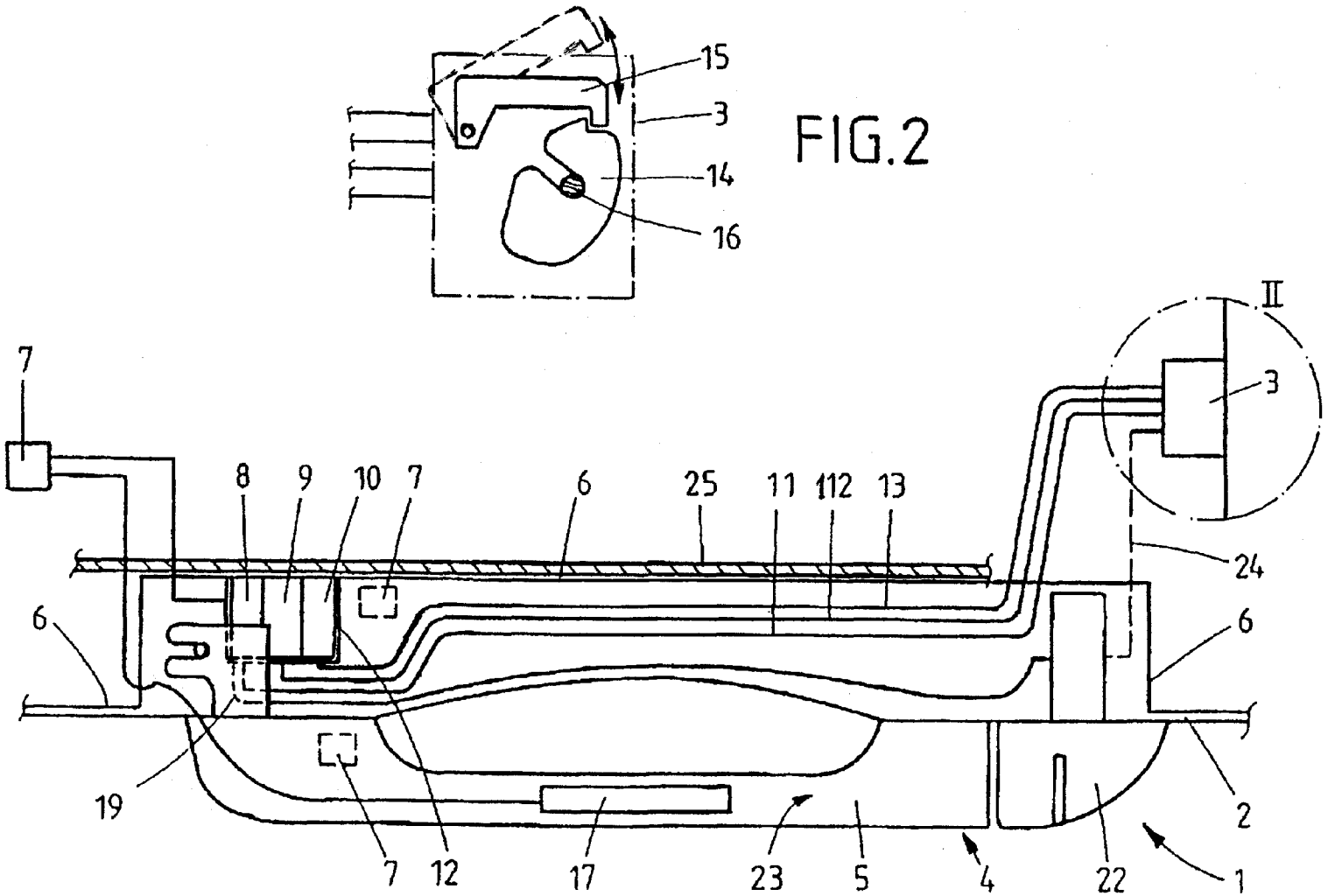
FIG. 1 shows in highly simplified manner a door handle closing system affixed to the motor vehicle door.
FIG. 2 shows a feasible embodiment mode of the mechanical lock of the closing system shown in FIG. 1.

FIG. 1 shows one embodiment mode of the closing system 1 of a motor vehicle door 2 comprising a mechanical lock 3. One applicable embodiment of the mechanical lock 3 is explicitly shown in FIG. 2. The mechanical lock 3 comprises lock elements in the form of a rotational catch 14 and a pawl 15. The rotational catch 14 may be moved into a main notch position and into a pre-notch position, such operation already being known in the state of the art. When the door 2 is closed, the pawl 15 acts directly on the rotational catch 14, a securing element 16 firmly affixed automobile body being received simultaneously and thereby the door 2 being reliably kept in its closed position. Illustratively the securing element 16 may be a metallic plunger or a bail. Alternative embodiment modes of mechanical locks are alternatively applicable too.

As shown in FIG. 1, a handle 4 is affixed to the door 2 and comprises an external grip element 5. In the present case the grip element 5 is a plastic injection molded part having thin walls and subtending a cavity 23 inside of it. The door handle 4 comprises a handle support 6 to affix it to the door 2. The affixation sites of the handle support 6 to the automobile body part of the door 2 are not explicitly shown in this embodiment mode.

The internally configured handle support 6 is made of a plastic shaped like a cap or dome. The handle support 6 as well as the grip element 5 are individual components of the door handle 4. However these elements may be joined to each other integrally. A centralized locking motor 8, an opening motor 9 acting as an opening accessory and a closing motor 10 acting as a closing accessory for the lock 3 are all affixed to the handle support 6. The centralized locking motor 8 moves the closing system 1 into a secured and into a disengaged state. The motors 8, 9, 10 are connected to a control unit 7. In the shown embodiment mode of the closing system 1, the accessory motors 9, 10 as well as the centralized locking motor 8 are received in a common housing 12. The housing 12 is made of plastic and protects the internally configured motors 8, 9, 10 from such damages as may occur during assembly. In especially advantageous manner, the motors 8, 9, 10 may be jointly affixed as a modular unit to the handle support 6, this feature allowing easy assembly carried out in minimum time. Obviously these three motors 8, 9, 10 also may be fixed individually and directly to the handle support 6.

On the inside, the door handle 4 is affixed by a fixed connection element 19 to the door part of the automobile body.

The accessory motors 9, 10 as well as the centralized locking motor 8 are connected by Bowden cables 11, 112, 13 to the lock 3. The side window 25 is situated behind the handle support 6 at the side away from the grip element 5.

The closing system 1 moreover comprises an emergency cylinder 22 mounted on the handle support 6 and connected to the centralized locking motor 8. In another alternative embodiment mode of the invention, said emergency cylinder 22 also may be connected indirectly to the lock 3 by a force transmitting element 24 which is shown in dashed lines in FIG. 1. A sensor 17 is configured within the cavity 23 of the grip element 5 and in this instance is capacitive. The sensor 17 is part of an omitted sensor unit inserted as a slide-in module into the cavity 23. The sensor 17 is mounted illustratively on a circuit board and is electrically connected to the control unit 7. Obviously a wireless link may also be used.

Illustratively the present closing system 1 may be in the form of an active or passive keyless entry system. When the user's hand nears the capacitive sensor 17, this approach is detected by the sensor which then transmits a signal to the control unit 7. Preferably an electronic access checking procedure ensues such as is already known from the German patent documents DE 103 31 440 A1 or DE 196 17 038 C2. Which are both incorporated herein into the present specification by reference in its entirety. The centralized locking motor 8—for instance a stepping motor—transmits through the Bowden cable 11 a displacement impulse allowing disengagement of the lock 3. However, prior to this, the opening motor 9 is driven and by means of the Bowden cable 112 facilitates the opening of the lock 3. More specifically, the opening motor 9 lifts the pawl 15 from its main notch position or its pre-notch position of the rotational catch 14 allowing rotation of the catch 14 under the influence of the centralized locking motor 8 via Bowden cable 11, thus effecting opening of the motor vehicle door lock 3.

The closing motor 10 is activated only after the opened vehicle door 2 has been moved into the closed position. In this process the closing motor 10 moves the rotational catch 14 into the main closed position shown in FIG. 2. In one preclosing position, this may involve reaching a pre-notch position, or reaching a specified position, of the motor vehicle door 2 relative to the automobile body, for instance at a residual gap of 6 mm. Thereupon and by means of the closing motor 10, the rotational catch 14 is easily moved into the main closed position. The closing motor 10 also is actuated by the control unit 7. For that purpose this control unit 7 also may be mounted on the handle support 6 or within the grip element 5 in the cavity 23.

The closing system 1 moreover may be disengaged manually by means of the emergency cylinder 22. A key may be inserted for that purpose into the emergency cylinder 22 and thereby, following rotation of that key, a displacement impulse may be transmitted toward the centralized locking element/motor 8 which in turn by means of the Bowden cable 11 disengages and/or opens the lock 3.

Figures 3, 4:
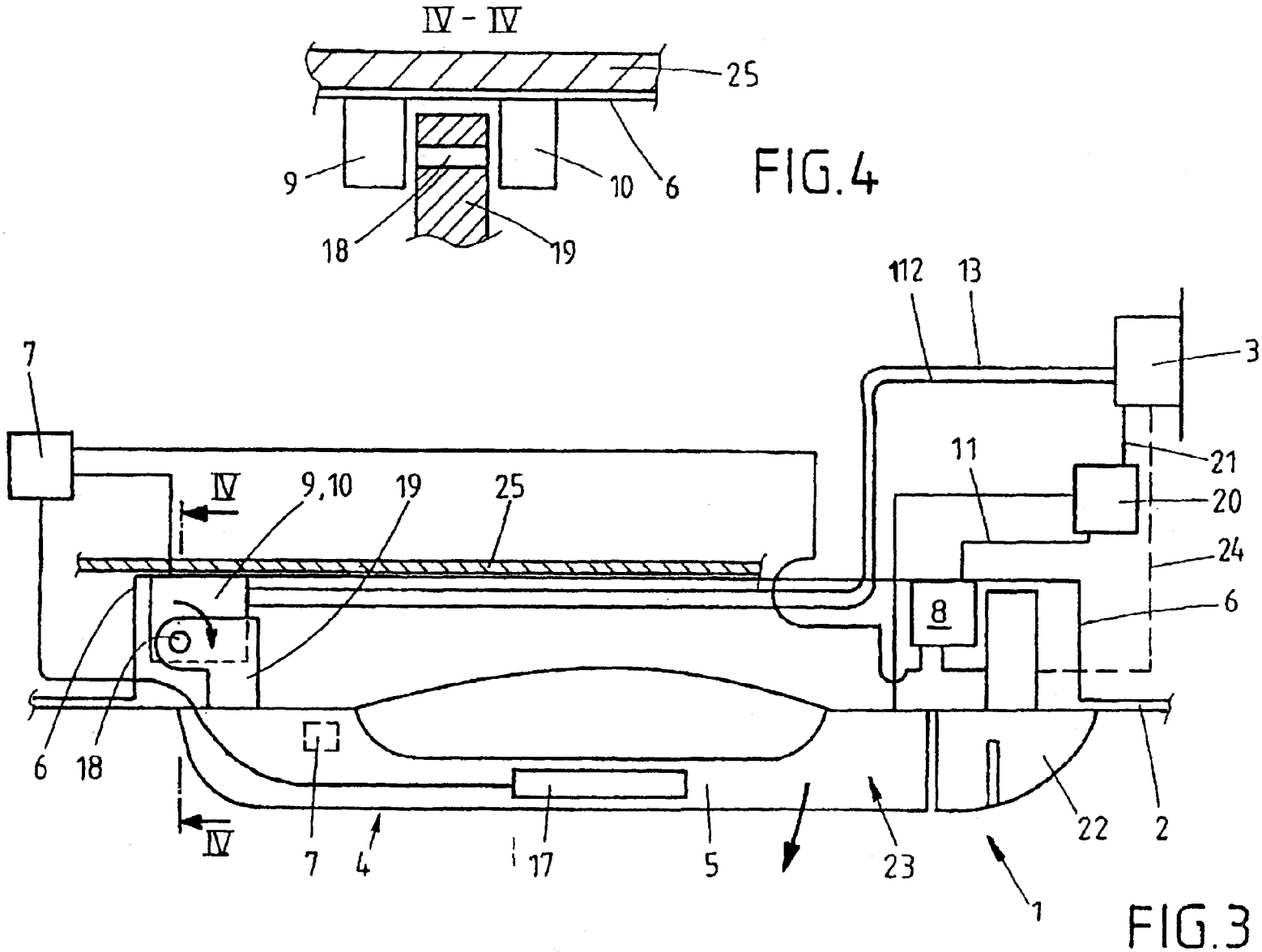
FIG. 3 shows another alternative embodiment mode of a closing system.
FIG. 4 is a sectional view along the line IV-IV of FIG. 3.

Contrary to the case of the embodiment mode of FIG. 1, FIG. 3 shows a door handle 4 comprising a displaceable grip element 5. The grip element 5 is manually pivotable about a pivot pin 18, the door handle 4 being fitted with an internal junction element 19 configured at its free end at the pivot pin 18 The user may open the vehicle door 2 by manually pulling the door handle 5. In this embodiment mode of the invention the grip element 5 again is fitted with a sensor 17 already described in relation to FIG. 1. Contrary to the design of the embodiment mode of FIG. 1, however, the closing system 1 [of FIG. 3] comprises a coupling 20 configured between the centralized locking motor 8 and the lock 3. The centralized locking motor 9 is operationally connected by the Bowden cable 11 to the coupling 20 which in turn is connected by an adjustment element 21 to the mechanical lock 3. Both the centralized locking motor 8 and the accessory motors 9, 10 are affixed to the handle support 6 that was already described in relation to the embodiment mode shown in FIG. 1. The opening motor 9 as well as the closing motor 10 are configured in the region of the pivot pin 18, the connecting element 19 being configured between the closing motor 10 and the opening motor 9 as illustrated in FIG. 4. Both the closing motor 10 and the opening motor 9 are flanged onto the handle support 6 and each are operationally connected by a Bowden cable 112, 13 to the mechanical lock 3. The centralized locking motor 8 is configured in the region of the emergency cylinder 22 and is also affixed to the handle support 6. The closing system 1 shown in FIG. 3 is fitted with a lock 3 as shown in FIG. 2

The accessory motors 9, 10 cited in the last two illustrative embodiment modes as well as the centralized locking motor may be electrically powered from the vehicle's power supply. Obviously as well the centralized locking motor 8 and/or the closing motor 10 and/or the opening motor 9 can be selectively operated from an auxiliary battery. In a preferred embodiment mode of the invention, it may be advisable to operate at least the opening motor 9 from an auxiliary battery so that, in an emergency, the motor vehicle door 2 can be opened manually.

As regards the embodiment mode shown in FIG. 3, the control unit 7 may be configured within the grip element 5 or at the handle support 6. The closing system 1 described in relation to FIG. 3 obviously also is applicable to a folding handle or to a revolver handle. In a further, omitted embodiment variation, the coupling 20 also may be affixed to the handle support 3.

The invention claimed is:

1. A closing system for a motor vehicle door or a flap, comprising:

a door handle affixed to the door and including an external grip element, the door handle being adapted to operate a lock having a pawl and a rotational catch, the pawl and catch being movable between an engaged and disengaged state relative to each other where the door is locked in an engaged state and unlocked in the disengaged state, the door handle further comprising:

a sensor disposed with the door handle to sense the immediate proximity or touch of an operators hand, a control unit responsive to an output of the sensor, an opening motor responsive to the control unit and operationally connected to the pawl of the lock by a first force transmitting element, so that the pawl is selectively movable from the engaged state to the disengaged state, and a centralized locking motor responsive to the control unit and directly connected with the rotational catch of the lock by a second force transmitting element for moving the rotational catch to the disengaged state, wherein the door handle includes a handle support disposed on an internal side of the door which is opposite to that one which the external grip element is disposed, the handle support affixing the door handle to the door, wherein the opening motor and the centralized locking motor are received in a common housing and mounted on the handle support.

2. The closing system as claimed in claim 1, wherein the opening motor and the centralized locking motor are integrated into one motor unit.

3. The closing system as claimed in claim 1, wherein each of the first and second force transmitting elements is a Bowden cable.

4. The closing system as claimed in claim 1, wherein the sensor is one of a contact and proximity sensor.

5. The closing system as claimed in claim 1, wherein the sensor is one of a capacitive sensor, a Hall effect generator and a piezoelectric sensor.

6. The closing system as claimed in claim 1, wherein the door handle is designed as one of a collapsing handle, a pull handle and a revolver handle.

7. The closing system as claimed in claim 6, wherein the grip element is manually pivotable about a pivot pin, the door handle includes an inside junction element which is mounted by a free end thereof to the pivot pin.

8. The closing system as claimed in claim 1, wherein the door handle further comprises an emergency cylinder mounted on the handle support.

9. The closing system as claimed in claim 1, wherein the control unit is mounted on the handle support.

10. The closing system as claimed in claim 1, wherein that the grip element of the door handle is a fixed grip element mounted on the door.

11. The closing system as claimed in claim 1, the handle further comprising a closing motor, to be activated only after an opened vehicle door has been moved into the closed position and a junction element being disposed between the closing motor and the opening motor.

12. The closing system as claimed in claim 1, wherein the centralized locking motor is proximate an emergency cylinder.

13. A motor vehicle fitted with a closing system as claimed in claim 1.

14. The motor vehicle of claim 13, wherein the opening motor and the centralized locking motor are integrated into one motor unit.

15. A closing system for a motor vehicle door, comprising:

a door handle affixed to the door and including an external grip element;

a handle support disposed on an internal side of the door opposite to that one which the grip element is disposed, the handle support affixing the door handle to the door;

a door lock having a first locking element movable between a locking position wherein the door is locked in a closed position and a release position wherein the door is released and movable from the locked position;

a centralized locking motor mounted on the handle support and connected to a control unit, the centralized locking motor being operatively connected with the first locking element and free of mechanical connection with the external grip of the door handle; and an opening motor mounted on the handle support and connected to the control unit, the opening motor being operatively connected with a second locking element which engages the first locking element and locks the first locking element in the locking position, the second locking element being free of mechanical connection with the external grip of the door handle;

wherein the centralized locking motor and the opening motor are received in a common housing and mounted on the handle support.

16. A closing system as set forth in claim 15, further comprising a closing motor mounted on the handle support and connected to the control unit.

17. The closing system as claimed in claim 1, further comprising a closing motor, the closing motor being connected to the rotational catch by a third force transmitting element.

18. The closing system as claimed in claim 17, wherein the opening motor, the centralized locking motor and the closing motor are integrated into a modular unit, wherein the modular unit is disposed in or immediately proximate the door handle.

19. The closing system as claimed in claim 18 wherein the closing motor is received in the common housing with the opening and centralized locking motors.

* * * * *